US006011249A

United States Patent [19]

Chung

[11] Patent Number: 6,011,249

[45] Date of Patent: Jan. 4, 2000

[54] MICROWAVE OVEN WITH HOT PLATE AND FOOD STIRRER

[76] Inventor: Jing Yau Chung, 13310 Pebblebrook, Houston, Tex. 77079

[21] Appl. No.: 09/132,376

[22] Filed: Aug. 11, 1998

Related U.S. Application Data

[60] Provisional application No. 60/055,597, Aug. 12, 1997.

[51] Int. Cl.[7] ..... H05B 6/78

[52] U.S. Cl. ..... 219/726; 219/685; 219/756; 426/243; 99/348; 99/DIG. 14

[58] Field of Search ..... 219/726, 756, 219/738, 685; 99/348, DIG. 14; 426/241, 243

[56] References Cited

U.S. PATENT DOCUMENTS 4,773,317 9/1988 Wickboldt, Jr. ..... 219/726
4,880,952 11/1989 Hirai et al. ..... 219/756
4,940,865 7/1990 Johnson et al. ..... 219/738
5,019,680 5/1991 Morino et al. ..... 219/726
5,255,444 10/1993 Oess ..... 219/756
5,363,746 11/1994 Gordon ..... 99/348

*Primary Examiner*—Philip H. Leung
*Attorney, Agent, or Firm*—Mark A. Oathout

[57] ABSTRACT

An oven is disclosed for cooking/heating a food product. The oven has a cylindrical sidewall, a top, a microwave magnetron and a hot plate mounted below and across the bottom of the sidewall. There is an access door on the top of the oven and an opening through the hot plate. A sweeper arm is mounted on top of the hot plate for moving and mixing the food product through the oven and out of the opening.

14 Claims, 1 Drawing Sheet

MICROWAVE OVEN WITH HOT PLATE AND FOOD STIRRER

This application is a utility application based on U.S. provisional application No. 60/055,597 filed Aug. 12, 1997.

BACKGROUND OF THE INVENTION

Most oriental entrees are traditionally prepared in a heated wok or pan. Fried rice, for example, is made with a mixture of cooked rice, vegetables, soy sauce, oil and spices, and all ingredients are stirred on a hot wok or Dan during the preparation. For commercial fast preparations of fried rice where the ingredients may be frozen at the initial stage, the use of a traditional cooking device may not produce desirable results. In fact, a special new cooking device is required for rapidly heating up the frozen ingredients while the normal frying process is in progress. This new device is the topic of the present invention. The present invention is not only designed to prepare the fried rice or other food products rapidly, but also to produce foods with a quality equal to that prepared by means of the traditional method.

SUMMARY OF THE INVENTION

An oven is disclosed for cooking/heating a food product. The oven has a cylindrical sidewall, a top, a microwave magnetron and a hot plate mounted below and across the bottom of the sidewall. There is an access door on the top of the oven and an opening through the hot plate. A sweeper arm is mounted on top of the hot plate for moving and mixing the food product through the oven and out of the opening.

Certain embodiments of this invention are not limited to any particular individual features disclosed, but include combinations of features distinguished from the prior art in their structures and functions. Features of the invention have been described so that the detailed descriptions that follow may be better understood, and in order that the contributions of this invention to the arts may be better appreciated. These may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. This invention is to be read to include any legally equivalent devices or methods which do not depart from the spirit and scope of the present invention.

The present invention recognizes, addresses and meets the previously-mentioned preferences or objectives in its various possible embodiments and equivalents thereof. To one of skill in this art who has the benefit of this invention's realizations, teachings. disclosures, and suggestions, other purposes and advantages will be appreciated from the following description and the accompanying drawings. The detail in the description is not intended to thwart this patent's object to claim this invention no matter how others may later disguise it by variations in form or additions of further improvements. These descriptions illustrate certain preferred embodiments and are not to be used to improperly limit the scope of the invention which may have other equally effective or legally equivalent embodiments.

DETAILED DESCRIPTION

Figure 1:
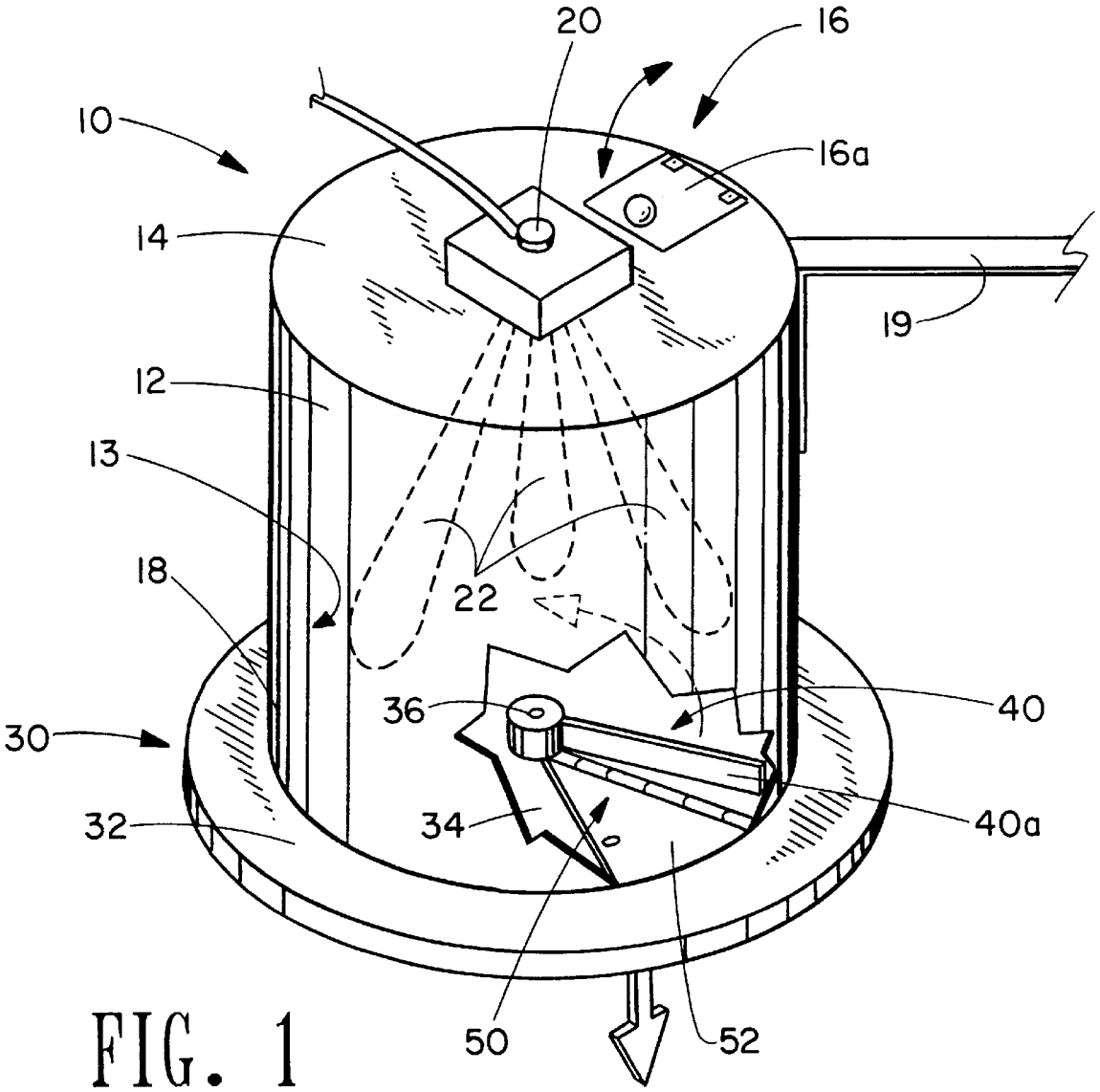
FIG. 1 is a perspective view of the invention.

The present invention is designed to meet the needs mentioned above by cooking and/or heating food products such as fried rice (not shown) in an oven 10 The food product may be introduced into the oven 10 in a frozen state, a refrigerated state or any other state. The oven 10 functions as both a microwave oven and a frying pan and includes a magnetron 20, a hot plate 30 and a sweeper 40.

The oven or microwave compartment 10 generally includes a sidewall 12, a top 14, a magnetron 20 and a base or hot plate 30. The sidewall 12 is preferably cylindrical to complement a concentric sweeper 40 for moving the food product as described below. However, the sidewall 12 could be configured differently. For example, the oven 10 could be configured in a box shape (including four square or rectangular sidewalls), a conical shape, an hour glass shape, etc.

The magnetron 20, as shown, may be mounted on the sidewall 12. The magnetron 20 could be placed at other locations on the oven 10 as would be known to one of ordinary skill in the art for producing the desired oscillations in the microwave region for cooking/heating the food product.

The oven 10 also includes an access 16 for introducing a food product or its ingredients into the oven 10. Door 16*a* is located at the top 14 of the oven 10 for accessing the oven 10 to introduce the ingredients. For example, to prepare vegetable fried rice, one would open the door 16*a* and drop cooked white rice, sauce, spices, vegetables and oil into the oven 10. The door 16*a* or some other suitable access could also be placed at some other location on the oven 10. The white rice may be presoaked with sauce and spices prior to being dropped into oven 10.

The oven 10 is mounted on and bounded on the bottom by a hot plate 30. An insulation layer may be placed at the juncture 18 between the sidewall 12 and the hot plate 30. The hot plate 30 in general is a heated metal plate 32. The portion 34 of the metal plate 32 within the oven 10 may be coated with TEFLON or some other coating suitable for preparing food products. The metal plate 32 may be heated by any suitable means such as by gas (flame), electricity, etc.

The hot plate 30 may be stationary or it may rotate with respect to the sidewall 12. If the hot plate 30 rotates, it may be rotated by any suitable means. For example, it may be rotated by an electric motor (not shown). The hot plate 30 could also be made such that only the portion 34 of the hot plate 30 lying within the sidewall 12 rotates. If the entire hot plate 30 rotates, then the sidewall 12 or top 14 should be fixed to some other stationary apparatus by a bracket 19 or the like to keep the sidewall 12 and top 14 from rotating and the juncture 18 between the sidewall 12 and the hot plate 30 must allow for motion between the two parts 12 and 30 and prevent the emission of microwaves 22 from the oven 10. By way of example, the bottom of the sidewall 12 could lightly touch the hot plate 30, or be very close (preferably less than one tenth of the wavelength of the microwaves 22) to hot plate 30 thereby allowing motion between the hot plate 30 and the sidewall 12 while preventing the escape of microwaves 22.

A sweeper 40 is mounted on the hot plate 30 for the purpose of mixing and moving or sweeping the food product across the hot plate 30 and through the oven 10. The size and shape of the sweeper 40 is somewhat dependent en the volume and type of food product in the oven 10. The sweeper 40 (shown) is a ½ inch tall non-metallic bar or arm 40*a*. The sweeper 40 could be a tapered, a brush or some other suitable device. The sweeper 40 can be coated with TEFLON. The height of the sweeper 40 must be sufficient to mix and move the food product through the microwave field 22 and the oven 10. By way of example, the sweeper could have a tapered surface or leading edge with a 45 degree pitch (not shown) and a one half inch height. Generally, for a food product such as rice the pitch and height should be smaller for smaller volumes rice and larger for larger volumes of rice.

The sweeper 40 may be moveable or stationary. If, for example, the hot plate 30 rotates, then the sweeper 40 could be fixed to the hot plate 30 so that it rotates with the hot plate 30. Or, the sweeper 40 could be fixed to the side-wall 12 where the bottom of the sweeper 40 is within close proximity of the hot plate 30, allowing the hot plate 30 to rotate beneath the sweeper 40. If the hot plate 30 is stationary, then the sweeper 40 should be joined through the hot plate 30 to a mechanism for rotating the sweeper 40 such as a drive shaft 42 driven by an electric motor (not shown). If the sweeper 40 rotates with respect to the hot plate 30, the bottom of the sweeper 40 should lightly touch or be within 1/16 inch of the top of the hot plate 30. It is preferred for the outer end of a rotating sweeper 40 to terminate proximate sidewall 12 to prevent food product from slipping between the sweeper 40 and the sidewall 12. The rotational speed of the sweeper 40 can be adjusted as needed to properly prepare the food product. Both hot plate 30 and sweeper 40 may be rotating in opposite directions to increase the speed of mixing the ingredients.

The oven 10 may have a second access or opening 50 for removing the food product. This opening 50 may be placed on the oven 10 at any suitable location. Presently, it is preferred for the opening 50 to be through the hot plate 30. When the food product is swept into the opening 50, it will automatically drop out of the oven 10. The shape of the opening 50 may vary, but it is preferred that the opening 50 extend from the center 36 of the hot plate 30 to the inner circumference 13 of the sidewall 12. The opening shown is a "pie" shaped opening 50. Any food product moved by the sweeper 40 over this opening 50 will drop through the opening 50 and out of the oven 10. A bowl, screen, chute (all not shown) or some other suitable device may be connected below the opening 50 to prevent or choke the emission of microwaves from the oven 10. The opening 50 is preferably staggered or offset from the position of the vertical projection of the access door 16*a* onto the hot plate 30. The opening 50 should be downstream from this projected position of the access door 16*a*, such that food product introduced through the access door 16*a* will fall onto the hot plate 30 and have a suitable distance to travel or be moved across the hot plate 30 and through the microwave field 22 to allow for adequate preparation (mixing, cooking/heating) of the food product before falling through opening 50. Accordingly, the sweeper 40 shown in the drawing should move in the counter-clockwise direction. As mentioned above, the opening 50 may be placed at other locations such as, for example, through the sidewall 12.

A door 52 may be placed in the opening 50. As a safety feature, door 16*a* and door 52 should remain closed while the microwaves are "on."

An exhaust system as described and disclosed in U.S. Pat. No. 5,771,786 (FIGS. 22 and 23; and column 11) is intended to be incorporated herein by reference and can be connected to the oven 10.

In conclusion, therefore, it is seen that the present invention and the embodiments disclosed herein are well adapted to carry out the objectives and obtain the ends set forth. Certain changes can be made in the subject matter without departing from the spirit and the scope of this invention. It is realized that changes are possible within the scope of this invention and it is further intended that each element or step recited is to be understood as referring to all equivalent elements or steps. The description is intended to cover the invention as broadly as legally possible in whatever form it may be utilized.

What is claimed:

1. An oven for cooking/heating a food product, comprising:

a sidewall;

a top connected to the sidewall;

a magnetron mounted proximate the oven;

the oven having a means for accessing the oven mounted on the oven;

a hot plate comprising a food preparation and a food frying surface mounted across a bottom of the sidewall;

a means for heating said hot plate proximate said hot plate; and a sweeper including a means for moving and mixing the food product across said hot plate mounted over said hot plate.

2. The oven according to claim 1, wherein said means for accessing the oven comprises a door mounted on the top of the oven.

3. The oven according to claim 1, further including an insulation layer placed between said hot plate and the sidewall.

4. The oven according to claim 1, wherein the sidewall is cylindrical.

5. The oven according to claim 1, wherein said sweeper comprises a non-metallic bar.

6. The oven according to claim 1, wherein said sweeper comprises a non-metallic brush.

7. The oven according to claim 1, further including a means for rotating said hot plate connected to said hot plate; and a means for rotating said sweeper connected through a center of said hot plate.

8. The oven according to claim 1, further including a means for rotating said hot plate connected to said hot plate.

9. The oven. according to claim 1, further including a means for rotating said sweeper connected through a center of said hot plate.

10. The oven according tc claim 9, wherein said hot plate includes an opening, a means for choking microwaves attached around the opening, and said means for accessing the oven is in a different vertical plane than the opening in said hot plate.

11. The oven according to claim 1, wherein said hot plate includes an opening and a means for choking microwaves attached around the opening.

12. The oven according to claim 1, wherein said hot plate is a metal plate.

13. An improved method for the rapid preparation of a food product, comprising the steps of:

placing the food product in an oven having a heated metal plate and a means for microwave heating;

frying the food product on the hot plate;

simultaneously mixing and moving the food product across the hot plate; and simultaneously mixing and moving the food product through the means for microwave heating.

14. The method according to claim 13, further including the steps of:

sweeping the food product over an opening through the hot plate; and dropping the food product through the opening and out of the oven.

* * * * *